United States Patent [19]

Komori et al.

[11] 4,146,324

[45] Mar. 27, 1979

[54] LIQUID DEVELOPING DEVICE IN ELECTROPHOTOGRAPHIC COPYING APPARATUS

[75] Inventors: Shigehiro Komori, Yokohama; Hiroyuki Hattori, Mitako; Hisashi Sakamaki, Yokohama; Koichi Miyamoto; Toshihide Iida, both of Tokyo; Kazumi Umezawa, Yokohama, all of Japan

[73] Assignee: Canon Kabushiki Kaisha, Tokyo, Japan

[21] Appl. No.: 719,469

[22] Filed: Sep. 1, 1976

Related U.S. Application Data

[63] Continuation of Ser. No. 548,758, Feb. 10, 1975, abandoned, which is a continuation of Ser. No. 266,633, Jun. 27, 1972, abandoned.

[30] Foreign Application Priority Data

Jul. 8, 1971 [JP] Japan ..... 46-50885

[51] Int. Cl.[2] ..... G03G 15/10; G03G 15/22

[52] U.S. Cl. ..... 355/10; 118/647; 118/652; 118/660

[58] Field of Search ..... 118/650, 647, 648, 649, 118/660, 652; 355/15, 30 R, 10; 427/15

[56] References Cited

U.S. PATENT DOCUMENTS

| | | | |
|---|---|---|---|
| 1,659,440 | 2/1928 | Pages | 118/413 X |
| 2,230,876 | 2/1941 | Wysong | 118/410 X |
| 2,243,333 | 5/1941 | Diescher | 118/413 X |
| 2,421,073 | 5/1947 | Kratz | 118/413 |
| 3,011,474 | 12/1961 | Ulrich | 118/647 |
| 3,284,224 | 11/1966 | Lehmann | 118/DIG. 23 |
| 3,285,225 | 11/1966 | Recor | 118/413 X |
| 3,576,623 | 4/1971 | Snelling | 118/DIG. 23 |
| 3,664,298 | 5/1972 | Giamo, Jr. | 118/DIG. 23 |
| 3,703,459 | 11/1972 | Little, Jr. et al. | 118/23 |
| 3,711,796 | 1/1973 | Saito et al. | 118/DIG. 23 |
| 3,752,119 | 8/1973 | Matkan | 118/DIG. 23 |
| 3,871,081 | 3/1975 | Inoue et al. | 355/15 X |

*Primary Examiner*—John McIntosh

*Attorney, Agent, or Firm*—Fitzpatrick, Cella, Harper & Scinto

[57] ABSTRACT

In an electrophotographic copying apparatus of the liquid development and transfer type, a liquid developing device includes a photosensitive drum, an arcuate developing electrode disposed below the photosensitive drum in opposed relationship therewith, and spacers disposed at the opposite ends of the developing electrode to maintain a predetermined clearance between the developing electrode and the photosensitive drum. Developing liquid may be supplied into the clearance to develop an electrostatic latent image on the photosensitive drum.

12 Claims, 10 Drawing Figures

LIQUID DEVELOPING DEVICE IN ELECTROPHOTOGRAPHIC COPYING APPARATUS

This is a continuation of application Ser. No. 548,758, filed Feb. 10, 1975, now abandoned, which in turn is a continuation of Ser. No. 266,633, filed on June 27, 1972, now abandoned.

BACKGROUND OF THE INVENTION

2. Field of the Invention

This invention relates to a developing device for a drum type photosensitive medium in an electrophotographic copying apparatus of the liquid development and transfer type.

2. Description of the Prior Art

The liquid development is superior to the dry type development in efficiency of development and quality of resultant copies, whereas the delicate action of the liquid development leads to the complicated arrangement of the portion whereat developing liquid is brought into contact with a photosensitive medium, and to the cumbersome control of the toner density in developing liquid and of the circulation system. Although the liquid development is free of the problem such as contamination which would otherwise arise from scattered developing powder, the handling or mounting and dismounting of a developing electrode and developing liquid container is very much complicated.

SUMMARY OF THE INVENTION

In view of these points, the present invention has generally made important improvements in various parts of the electrophotographic copying apparatus of the described type.

With such a copying apparatus, an electrostatic latent image is formed on a rotating photosensitive drum through the processes such as charging and through-slit exposure, whereafter the latent image is liquid-developed by a developing device. The developing device may comprise a container for developing liquid, pump means for stirring and raising the developing liquid, and a developing electrode. The developing electrode is arranged to be urged toward the photosensitive drum with a very slight clearance normally formed therebetween. The latent image on the photosensitive drum is visualized by the toner in the developing liquid. Any excess amount of the developing liquid on the photosensitive drum is electrically charged for removal without disturbing the formed image, whereafter the image is transferred to a transfer medium. The transfer medium is separated from the photosensitive drum by a separator belt and directed to a drying-fixing station. A blade cleaner urged into contact with the surface of the photosensitive drum wipes the successive surface portions of the photosensitive drum to remove any residual toner and developing liquid therefrom. Thereafter, a subsequent copy cycle may be repeated.

According to a specific embodiment of the present invention, spacers having a low frictional resistance and high wear resistance with respect to the photosensitive drum are provided adjacent to the four corners or the opposite ends of the developing electrode, whereby the clearance between the photosensitive drum and the developing electrode may be maintained uniformly.

The developing electrode takes an arcuate shape complementary to the photosensitive drum so as to maintain a uniform clearance therebetween. Through a slit formed in the developing electrode at the lowermost portion thereof, developing liquid is injected upwardly to fill the slight clearance between the drum and the electrode to thereby visualize the electrostatic latent image on the surface of the photosensitive drum. For this purpose, the developing electrode is supported on a developing electrode support member in such a manner that the position of the electrode relative to the photosensitive drum may be variably set.

BRIEF DESCRIPTION OF THE DRAWINGS

The invention will become more apparent from the following detailed description thereof taken in conjunction with the accompanying drawings, in which.

DESCRIPTION OF THE PREFERRED EMBODIMENTS

Figure 2:
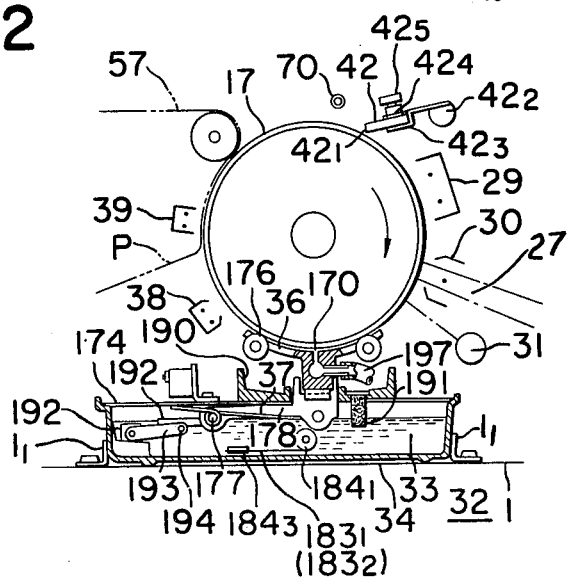
FIG. 2 is a transverse sectional view of the developing device.
Figure 4:
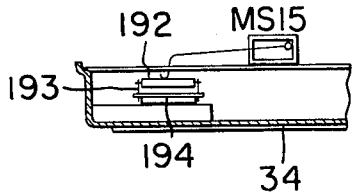
FIG. 4 is a side view of a liquid level detector float portion in the developing device.
Figure 3:
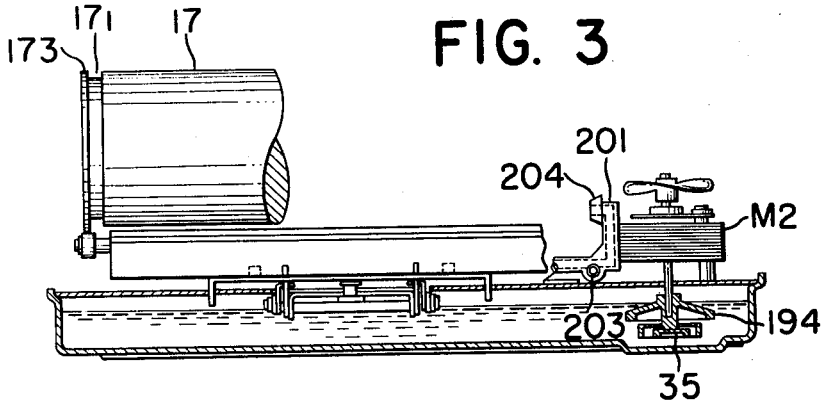
FIG. 3 is a front view, in longitudinal section, of the developing device.

Although the present invention is not directed to the entire construction of a copying apparatus, such invention will be described in general with respect to an entire representative apparatus. In FIG. 2, a photosensitive drum 17 comprises a photosensitive layer covered with a transparent dielectric layer and is rotatable in clockwise direction as viewed in the figure. The photosensitive drum is first charged with positive polarity by a primary charger 29 and, at an exposure station 27, it is exposed to an original image through a slit while it is simultaneously subjected to AC discharge or secondary DC charge of the opposite polarity by a discharger 30. Subsequently, the photosensitive drum is subjected to an overall exposure by a lamp 31 to thereby form an electrostatic latent image on the surface thereof, and then enters a developing device 32. The developing device comprises a container 34 for a body of developing liquid 33, a pump 35 (FIG. 3) for stirring and raising the developing liquid, and a developing electrode 36. The developing electrode 36 is adapted to be urged toward the photosensitive drum 17 with a slight clearance normally formed therebetween. The electrostatic latent image formed on the photosensitive drum 17 is developed into a visible image by the toner contained in the developing liquid 33 as raised onto the developing electrode 36 by the pump 35.

Subsequently, the photosensitive drum 17 is charged by a post-charger 38 so that any excess amount of the developing liquid on the drum surface is squeezed for removal without disturbing the image on the drum. Thereafter, a sheet of transfer paper P as fed from a paper feed station is brought into intimate contact with the photosensitive drum 17 so that the image on the photosensitive drum 17 is transferred to the transfer paper P through the charging by a transfer charger 39. After the image transfer has been completed, the transfer paper P is separated from the photosensitive drum 17 by a separator belt 57 and directed to a drying-fixing station. A blade cleaner 42, urged into contact with the photosensitive drum 17, wipes the drum to remove any residual developing liquid and toner. Thus, the photosensitive drum is now ready for a next copy cycle.

Figure 5:
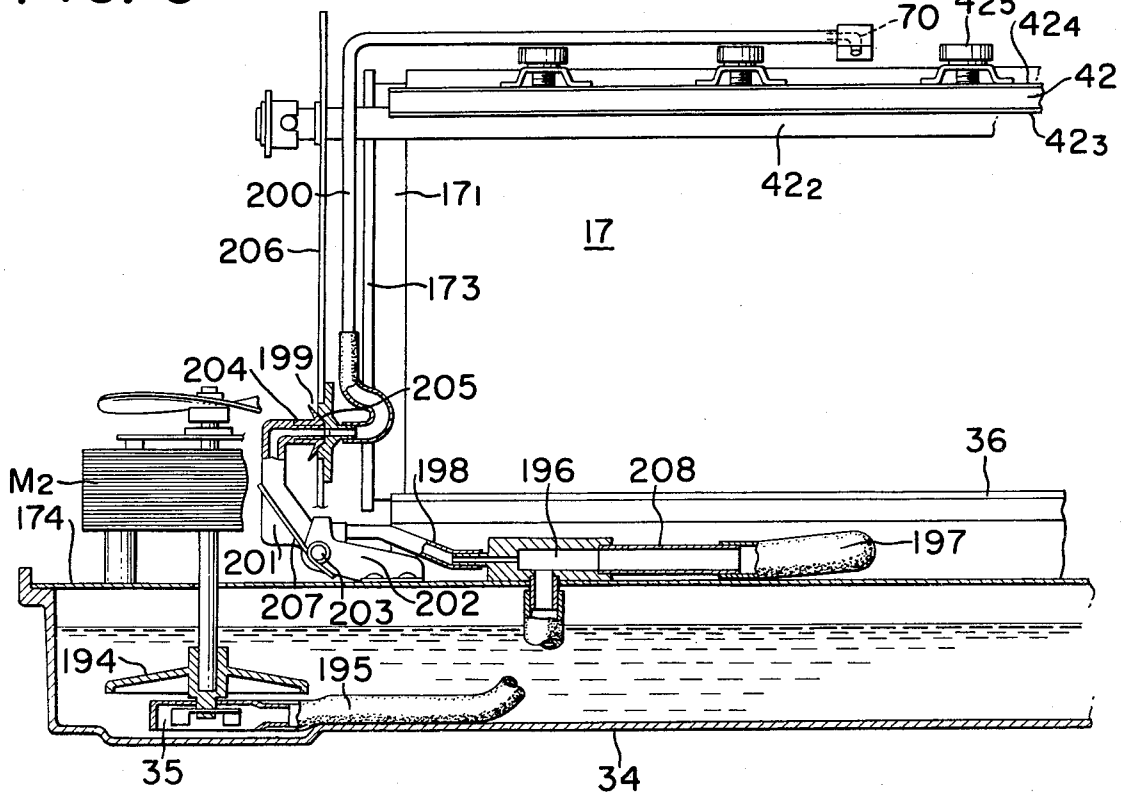
FIG. 5 is a rear view, in longitudinal section, of the mechanisms in the developing device for stirring the developing liquid and for supplying the developing liquid to the developing electrode and to the cleaning station.
Figure 7:
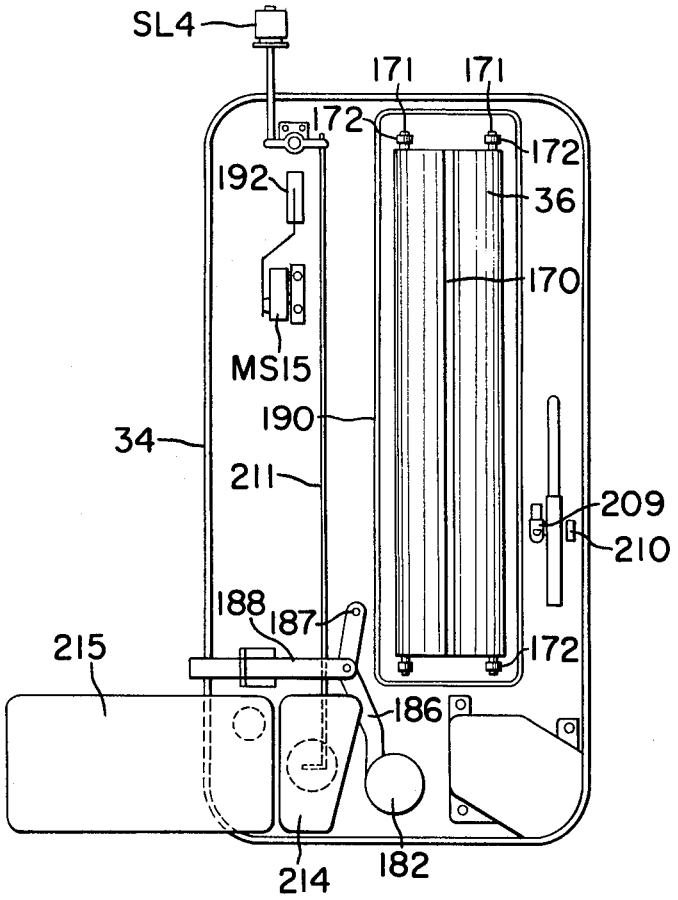
FIG. 7 is a plan view of an automatic toner supply mechanism in the developing device.

During a down-time after the completion of the copying operation, the toner in the developing liquid tends to deposit on the surface of the photosensitive drum 17 due to evaporation of the carrier liquid. Also, a very small amount of toner normally tends to build up in the neighborhood of the edge portion $42_1$ of the blade cleaner 42 which is used to wipe off the toner and developing liquid remaining on the photosensitive drum after image transfer. If the apparatus is left inoperative for an extended period under such conditions, the carrier present at the blade edge portion $42_1$ would evaporate and solidify the toner. If the drum 17 resumes its rotation under these conditions, the solidified toner would injure the edge $42_1$ of the blade cleaner 42 and/or the surface of the drum 17, thus adversely affecting the resultant copy image. To avoid this, the copying apparatus is so arranged that closing of a main switch (not shown) does not start rotation of the drum 17 but only energizes a motor M2 and pump 35 (FIG. 3) for the developing device, so that the pump begins to stir and raise the developing liquid 33 through a liquid supply pipe 70 (FIG. 2) to wash the blade cleaner 42. After a predetermined time, the toner solidified at the edge portion $42_1$ of the blade cleaner 42 is fluidized, whereupon the photosensitive drum 17 begins to rotate and wipe off the fluidized toner. The developing liquid thus wiped off flows along grooves $17_1$ (FIG. 3) formed at the opposite ends of the photosensitive drum 17, and further flows down into the developing device 32 for reuse. The blade 42, as shown in FIGS. 2 and 5, is supported by an arm $42_3$ attached to a cross rod $42_2$ and held by a keep plate $42_4$ supported on the blade. The blade 42, arm $42_3$ and keep plate $42_4$ are fastened together by fastening screws $42_5$.

In the above-described arrangement wherein the developing electrode 36 is opposed to the photosensitive drum 17 with a slight clearance therebetween so that the clearance may be filled with developing liquid for developing the latent image on the surface of the drum 17, it is most essential that the clearance between the drum and the electrode be properly maintained.

Figure 6:
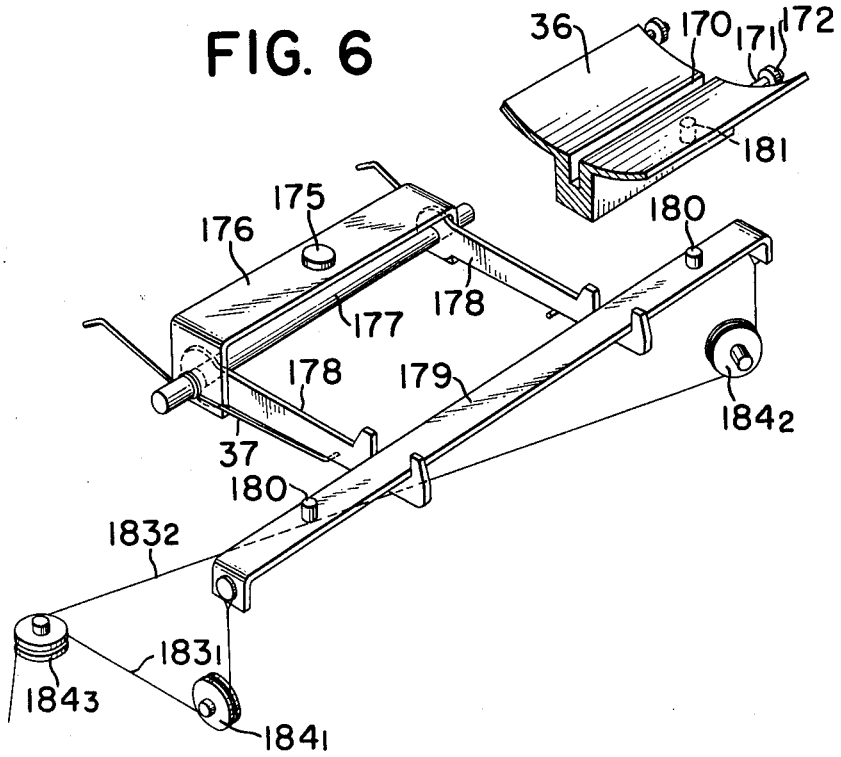
FIG. 6 is a perspective view of a mechanism in the developing device for vertically moving the developing electrode.

In view of this, the present invention provides a predetermined clearance between the photosensitive drum 17 and the developing electrode 36 by disposing spacers at the opposite ends of the developing electrode 36 and in contact with the photosensitive drum 17. Where the photosensitive medium 17 is in the form of a drum as shown, the electrode 36 correspondingly takes an arcuate shape formed with a slit 170 through the lowermost portion thereof, as shown in FIG. 6. Instead of the slit 170, a row of small apertures may be formed. Developing liquid is injected upwardly through such slit 170 or small apertures to fill the slight clearance between the drum 17 and the electrode 36 to thereby visualize the electrostatic latent image on the surface of the photosensitive drum.

The spacers provided at the opposite ends or four corners of the developing electrode 36 may be formed of a material having a low frictional resistance and high wear resistance with respect to the photosensitive drum 17. In the illustrated embodiment, each of such spacers may comprise a roller of nylon 172 mounted by means of a shaft 172 and bearing against the edge 173 of the groove $17_1$ formed at each end of the photosensitive drum 17.

A bearing frame 176 is mounted for horizontal pivotal movement on the back side of the lid 174 of the developing device 34 by means of a vertical pin 175 (FIG. 6). The frame 176 supports a cross shaft 177, from which a pair of support arms 178 extend forwardly (as viewed in FIG. 6). A developing electrode support member 179 having pins 180 studded therein extends across and rests on the support arms 178. The support member 179 supports the developing electrode 36 with the pins 180 received in holes 181 formed in the underside of the developing electrode 36. The arms 178 are normally biased upwardly by springs 37 to urge the spacer rollers 172 (four in total) against the opposite edges 173 of the photosensitive drum 17. Thus, all the spacer rollers are uniformly urged against the edges 173 due to the vertical pivotal movement about the shaft 177 and to the horizontal pivotal movement about the shaft 175, so that the clearance between the drum 17 and the electrode 36 is maintained uniformly at any area thereof.

The developing liquid container 34 may be advanced and retracted with respect to the apparatus body 1 along guide rails $1_1$. During such movement of the developing liquid container, it is necessary to prevent the spacer rollers 172 from contacting the photosensitive drum 17 to injure the latter. For this purpose, an integral drum and knob 182 mounted on the lid 174 of the container 34 at one end thereof may be rotated clockwise as viewed in FIG. 1, whereby the drum integral with the knob takes up ropes $183_1$, $182_2$ secured at one end to the drum as at $182_1$ and at the other end to the opposite ends of the developing electrode support member 179 via idlers $184_1$, $184_2$, respectively, so that the support member 179 is lowered about the shaft 177, thus lowering the developing electrode 36 to move the rollers 172 away from the photosensitive drum 17. At the same time, an eccentric pin 185 formed on the knob 182 is revolved to swing a lever 186 counter-clockwise about a shaft 187, as viewed in FIG. 1, thereby rotating a lock bar 188 out of engagement with a lock member 189 provided on the apparatus body 1 and thus releasing the developer container 34 for free movement.

Amounts of the developing liquid which overflow from the developing electrode 36 are collected in a receptacle 190 disposed below the electrode and on the lid 174, and such collected liquid is filtrated through a filter 191 to separate dust and solidified toner therefrom, and then returned to the container 34. The lid 174 and receptacle 190 are formed with openings through which the support arms 178 for the developing electrode support member, etc. may be projected upwardly.

When the developing liquid 33 in the container 34 reaches a predetermined residual level, the corresponding lowering of a float 192 is detected by a microswitch MS15 to electrically effect the indication of the residual amount. The float is supported by a float support arm 193 which is pivotally mounted to the container 34 or to the lid 174 by means of a shaft 194. A bulwark member 195 is provided within the container 34 to prevent the float from being affected by the turbulent flow of the developing liquid, and a communication passageway $195_1$ is formed at a portion or the bottom of the bulwark member 195.

As mentioned previously, closing of the main switch energizes the motor M2 to rotate stirrer blades 194 and pump 35 in the body of developing liquid so that, as seen in FIG. 5, the developing liquid is passed through pipe 195', branching portion 196, pipe 197 into the slit 170 in the developing electrode. On the other hand, part of the developing liquid from the container 34 is supplied through branching portion 196, pipe 198, connecting portion 199, pipe 200 into liquid supply pipe 70, from which the liquid is supplied as cleaning liquid to the blade cleaner 42 as described previously.

To enable the developer container 34 to be removed out of the apparatus body 1 for the inspection and/or maintenance thereof, the connecting portion 199 between the cleaning liquid supply line 198 of the developing device and the pipe 200 of the apparatus body may desirably be a self-connection simply utilizing a pressure contact. This may be accomplished in the manner described hereunder. An L-shaped pipe 201 is connected at one end to the pipe 198 of the developing device and journalled at the other end to a bearing 202 on the lid 174 by means of a shaft 203. A coupling 204 having a conical end facing the photosensitive drum is coupled to the upper end of the pipe lever 201, and a coupling 205 corresponding thereto is coupled to the pipe 200. The two couplings may be secured to an apparatus frame 206. One or both of these couplings 204 and 205 may be formed of elastic material such as rubber or the like. Upon insertion of the developing device into the apparatus body 1, the two couplings are matched with each other and the coupling 204 tends to be urged outwardly to pivot the pipe lever 201 about the shaft 203, but such tendency is blocked by a spring 207 which biases the pipe lever 201 so as to maintain the two couplings 204 and 205 in close and liqid-tight contact.

Figure 1:
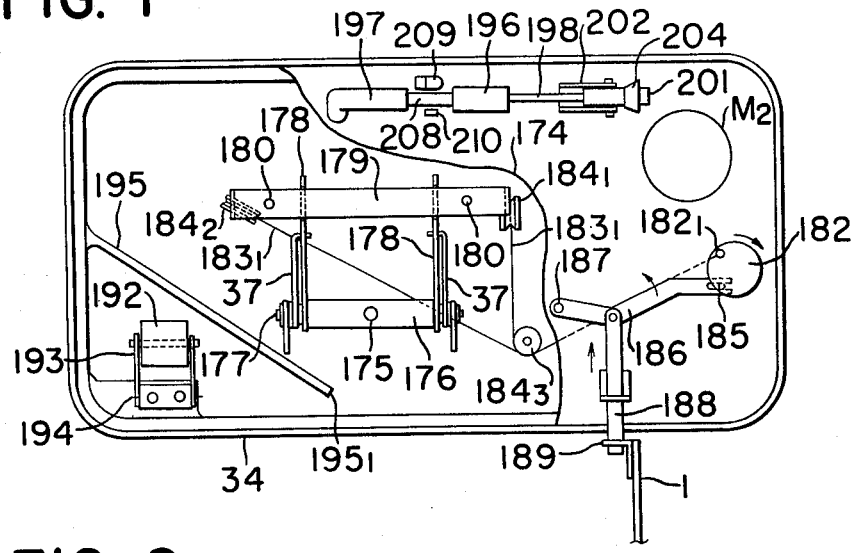
FIG. 1 is a plan view of the developing device according to an embodiment of the present invention.
Figure 8:
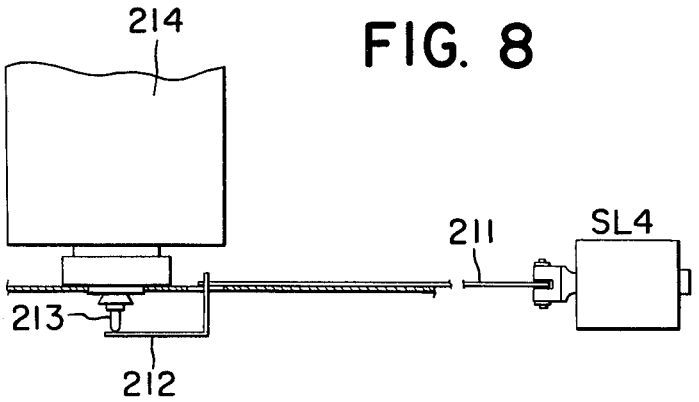
FIG. 8 is a front view, in longitudinal section, of a portion of the mechanism shown in FIG. 7.

As shown in FIGS. 1 and 5, a transparent glass tube 208 is located intermediately of the pipe 197 leading to the developing electrode 36. The density of the developing liquid as it passes through the glass tube may be detected by photoelectric means comprising a lamp 209 and a light receiving element 210 such as CdS or the like. When the toner in the developing liquid is reduced to such an extent that the density thereof is lower than a predetermined level, the photoelectric means may produce an electrical signal at a predetermined point of time synchronized with the copy cycle as by utilization of the rotation of the drum. (Otherwise, developing liquid would be supplied when the liquid does not reach the glass tube 208 as is usual immediately after the initiation of the copy cycle.) The electrical signal thus produced energizes a solenoid SL4 (FIG. 8), which in turn actuates a rod 211 and a lever 212 to raise a tank cap shaft 213 so as to permit denser liquid in a tank 214 to be supplied. Supply of diluted liquid may be effected from a diluted liquid tank 215 in the so-called chicken-feed fashion.

The connection terminals for various elements installed in the developing device such as motor M2, density detector lamp 209, light receiving element 210, microswitch MS15 for the float, solenoid SL4 for the liquid supply, are arranged such that they may be automatically connected upon insertion of the developing device into the apparatus body. It should be understood that the aforesaid filter 191 (FIG. 1) is immersed in the turbulent flow of developing liquid so as to prevent clogging thereof.

Figure 9:
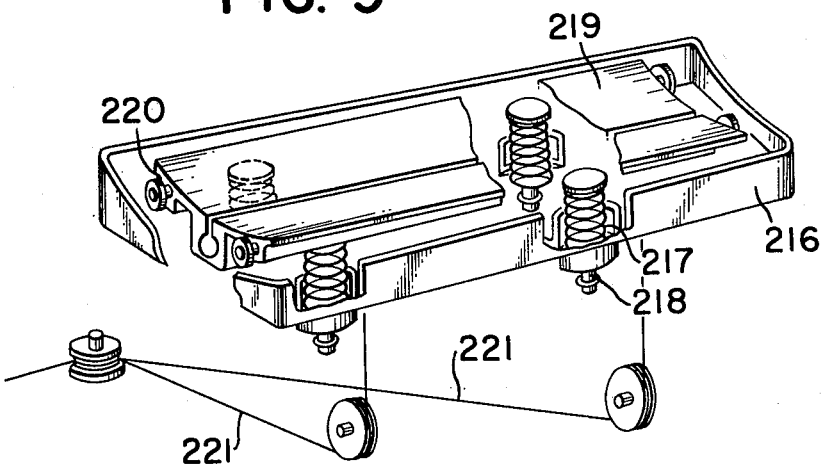
FIG. 9 is a perspective view showing another embodiment of the liquid developing device according to the present invention.
Figure 10:
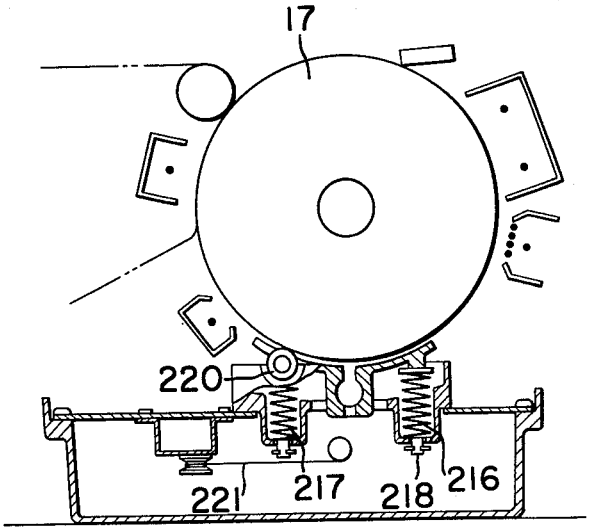
FIG. 10 is a transverse sectional view showing essential parts of a copying apparatus to which the developing device of FIG. 9 has been applied.

FIGS. 9 and 10 show another embodiment of the means for uniformly urging the spacers so as to form a uniform clearance between the developing electrode and the photosensitive drum. Spring means is provided below each of the spacers disposed at the four corners of the developing electrode.

We claim:

1. A liquid developing device in an electrophotographic copying apparatus of the liquid development and transfer type, wherein the apparatus includes a photosensitive drum having a surface for bearing an electrostatic latent image, said device comprising:

an arcuate developing electrode disposed adjacent said photosensitive drum and in an opposed relationship with said surface of said photosensitive drum;

electrode support means including first and second pairs of support members extending respectively from opposite ends of said developing electrode, and means for engaging said support members for uniformly supporting said electrode with respect to said surface of the photosensitive drum and for maintaining said pairs of extending members in a predetermined spaced relationship with said drum surface to thereby maintain a corresponding predetermined clearance between said developing electrode and the surface of said photosensitive drum;

means bearing said developing electrode and support means for permitting said electrode and support means to move pivotally toward and away from said surface of said photosensitive drum between operating and inoperative positions and also pivotally in a plane transverse thereto; and means for supplying developing liquid into said clearance between the drum surface and the electrode whereby said developing liquid supplied into said clearance is to develop an electrostatic latent image formed on the surface of said photosensitive drum.

2. A liquid developing device in an electrophotographic copying apparatus of the liquid development and transfer type, wherein the apparatus includes a photosensitive drum having a surface for bearing an electrostatic latent image, said device comprising:

an acruate developing electrode disposed adjacent said photosensitive drum and in an opposed relationship with said surface of said photosensitive drum;

electrode support means including first and second pairs of support members extending respectively from opposite ends of said developing electrode, and means for engaging said support members for uniformly supporting said electrode with respect to said surface of the photosensitive drum and for maintaining said pairs of extending members in a predetermined spaced relationship with said drum surface to thereby maintain a corresponding predetermined clearance between said developing electrode and the surface of said photosensitive drum;

means bearing said developing electrode and support means for permitting said developing electrode and support means to move pivotally toward and away from said surface of said photosensitive drum between operating and inoperative positions and also pivotally in a plane transverse thereto;

a tank for storing developing liquid;

first supply means for supplying developing liquid from the tank into said clearance between the drum surface and the electrode, for developing an electrostatic latent image formed on the surface of the photosensitive drum; and second supply means for supplying the developing liquid to the drum at a position between a transfer position and an image forming position.

3. A liquid developing device in an electrophotographic copying apparatus of the liquid development and transfer type, said device comprising a photosensitive drum, an arcuate developing electrode disposed below said photosensitive drum in opposed relationship therewith, and spacers disposed at the opposite ends of said developing electrode to maintain a predetermined clearance between said developing electrode and said photosensitive drum, support arms and a developing electrode support member provided to permit said developing electrode to be pivotally moved in vertical and horizontal planes, and said spacers at the opposite ends of said developing electrode being in uniform contact with said photosensitive drum, whereby developing liquid may be supplied into said clearance to develop an electrostatic latent image formed on the surface of said photosensitive drum.

4. A liquid developing device in an electrophotographic copying apparatus of the liquid development and transfer type, said device comprising a photosensitive member, a developing electrode disposed adjacent said photosensitive member in opposed relationship therewith, and spacer means disposed at an end of said developing electrode to maintain a predetermined clearance between said developing electrode and said photosensitive member and a developing electrode support member provided to permit said developing electrode to be pivotally moved in vertical and horizontal planes, and said spacer means being in contact with said photosensitive member, whereby developing liquid may be supplied into said clearance to develop an electrostatic latent image formed on the surface of said photosensitive member.

5. A device according to claim 4, wherein said spacer means includes a pair of rollers mounted at both ends of said developing electrode adjacent to non-imaging portions of said photosensitive member.

6. A device according to claim 4, wherein said developing electrode support member is a resilient member normally biasing said developing electrode toward said photosensitive member.

7. A device according to claim 4, wherein said developing electrode defines an opening for supplying developer liquid therethrough to said clearance.

8. An apparatus for developing an electrostatic latent image formed on a drum-shaped electrostatic latent image bearing member with a liquid developer comprising:

(a) a container for storing liquid developer;

(b) an arcuate developing electrode disposed adjacent to and in opposed relationship with said latent image bearing member;

(c) a liquid developer supply pipe having an outlet for supplying liquid developer between said arcuate developing electrode and said latent image bearing member;

(d) pump means for feeding liquid developer from said container to said supply pipe;

(e) supporting means, mounted on said developing electrode, for supporting said developing electrode in opposed relationship with said latent image bearing member;

(f) means bearing said developing electrode and said supporting means for permitting said electrode and said supporting means to move pivotally toward and away from said latent image bearing member and also pivotally in a plane transverse thereto; and (g) means for holding said supporting means at a predetermined distance from said latent image bearing member to maintain a predetermined clearance between a surface of said developing electrode and a surface of said latent image bearing member to facilitate liquid development when said holding means is in its operative position and, when said holding means is in its inoperative position, allows said developing electrode to move away from said latent image bearing member without contacting said image bearing member in order that said latent image bearing member and said developing electrode may be removed from or placed into a copy machine.

9. A developing device comprising:

a surface for bearing an electrostatic image to be developed;

a developing electrode disposed adjacent said surface in opposed relationship therewith;

spacer means disposed at at least one end of said developing electrode to maintain a predetermined clearance between said developing electrode and said surface, wherein said spacer means uniformly contacts a non-imaging portion of said electrostatic image bearing surface; and a developing electrode support member provided to permit said developing electrode to be pivotally moved in vertical and horizontal planes;

whereby developer may be supplied to said clearance to develop said electrostatic image bearing surface.

10. A developing device comprising:

a surface for bearing an electrostatic image to be developed;

a developing electrode disposed adjacent said surface in an opposed relationship therewith;

electrode support means, mounted on said developing electrode, for supporting said developing electrode in opposed relationship with said electrostatic image bearing surface;

means for permitting said electrode and said electrode support means to move pivotally toward and away from said electrostatic image bearing surface and also pivotally in a plane transverse thereto; and means for holding said electrode support means at a predetermined distance from said electrostatic image bearing surface to maintain a predetermined clearance between a surface of said developing electrode and said electrostatic image bearing surface to facilitate development when said holding means is in its operative position and when said holding means is in its inoperative position, spaces said developing electrode away from said electrostatic image bearing surface without contacting said electrostatic image bearing surface to facilitate relative movement between said electrostatic image bearing surface and said developing electrode.

11. In an electrostatic image reproducing apparatus having a movable photoreceptor member comprising:

means for forming an electrostatic latent image on said member;

development means for applying developing material to the latent image to develop the same; and a transfer station adjacent the moving photoreceptor member for transferring a developed image; the improvement comprising:

a developing electrode;

spacer means for maintaining a predetermined clearance between said developing electrode and said photoreceptor member; and developing electrode support means for permitting said developing electrode to move pivotally in vertical and horizontal planes.

12. In an electrophotographic copying apparatus comprising means for charging a photo-conductive member with an electrostatic charge, means to expose said charged member to imaging light, means to develop said exposed member to imaging light, means to develop said exposed member with toner particles, the improvement comprising:

applicator means for applying the toner particles to the photoconductive member;

spacer means mounted on opposite ends of said applicator means to maintain a predetermined clearance between said applicator means and said photoconductive member, said spacer means being in uniform contact with a mon-imaging area of said photoconductive member; and support means provided to permit said applicator means to be pivotally moved in each of two planes transverse with respect to one another;

whereby toner particles may be supplied into said clearance to develop said exposed photoconductive member.

* * * * *

UNITED STATES PATENT OFFICE

CERTIFICATE OF CORRECTION

Patent No. 4,146,324 Dated March 27, 1979

Inventor(s) SHIGEHIRO KOMORI, ET AL

It is certified that error appears in the above-identified patent and that said Letters Patent are hereby corrected as shown below:

Column 1, line 11, "2" should read --1--;

Column 4, line 13, "172" should read --171--;

Column 4, line 44, "$182_2$" should read --$183_2$--;

Claim 2, Column 6, line 51, "acruate" should read --arcuate--;

Claim 12, Column 10, line 11, "mon-imaging" should read --non-imaging--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*